US005656332A

United States Patent [19]

Saito et al.

[11] Patent Number: 5,656,332

[45] Date of Patent: Aug. 12, 1997

[54] METHOD OF MANUFACTURING A LONG CONTINUOUS TUBE HAVING A COATING OF BRAZING POWDERS

[75] Inventors: Hitoshi Saito, Numazu; Hiroto Momosaki; Ken Tohma, both of Mishima, all of Japan

[73] Assignee: Mitsubishi Aluminum Kabushiki Kaisha, Tokyo, Japan

[21] Appl. No.: 424,649

[22] Filed: Apr. 19, 1995

[30] Foreign Application Priority Data

| | | | |
|---|---|---|---|
| Apr. 20, 1994 | [JP] | Japan | 6-082018 |
| Dec. 12, 1994 | [JP] | Japan | 6-307445 |
| Apr. 4, 1995 | [JP] | Japan | 7-079092 |

[51] Int. Cl.[6] ..... B05D 1/02; B05B 13/02

[52] U.S. Cl. ..... 427/421; 427/177; 427/372.2; 427/424; 118/324; 118/DIG. 11; 29/890.045; 29/890.046; 29/890.047; 29/890.049; 29/DIG. 4

[58] Field of Search ..... 427/177, 421, 427/424, 372.2; 29/890.045, 890.046, 890.047, 890.049, DIG. 4; 228/262.51; 219/615, 85.1; 148/528; 165/133, 180, 181; 118/DIG. 11, 324

[56] References Cited

U.S. PATENT DOCUMENTS

| | | | |
|---|---|---|---|
| 3,908,593 | 9/1975 | Rossi et al. | 118/DIG. 11 |
| 4,768,280 | 9/1988 | Palmer et al. | 118/DIG. 11 |
| 5,421,516 | 6/1995 | Saitou et al. | 239/121 |

*Primary Examiner*—Shrive Beck
*Assistant Examiner*—David M. Maiorana
*Attorney, Agent, or Firm*—Wenderoth, Lind & Ponack

[57] ABSTRACT

A long continuous tube, strip or like material has a coating of brazing powders applied and formed thereon. It may be cut to sections of specific length when actually used. A uniform coating of brazing powders is applied in specific quantities and fixed onto the long continuous tube, strip or like material. A travel path has a tube made from aluminum or aluminum alloy running therealong. At least one spray gun section projects a coating mixture of brazing powders toward the travel path. A pressurized air supply section supplies pressurized air to the spray gun section, and a coating mixture supply section includes a coating mixture circulating arrangement and a feed line. A drying section is provided downstream of each respective spray gun section, and a rewinding section is provided at the end of the travel path. The tube runs at a constant speed along the travel path and passes through the first spray gun section, where a coating mixture of brazing powders is applied against one side of the tube, and the other goes through the first drying section, where the coating is dried and fixed. Then, the tube is reversed, running in the opposite direction and passing through the second spray gun section, where a coating mixture of brazing powders is applied against the opposite side of the tube. It then goes through the second drying section, where the coating is dried and fixed. The finished tube is finally would up in a coil at a rewinding section.

15 Claims, 4 Drawing Sheets

METHOD OF MANUFACTURING A LONG CONTINUOUS TUBE HAVING A COATING OF BRAZING POWDERS

BACKGROUND OF THE INVENTION

1. Field of the Invention

The present invention relates generally to a long continuous tube, strip or like material having a coating of brazing powders formed along its length. It also provides a method of and an apparatus for manufacturing such long continuous tubes, strips or the like. More specifically, the long continuous tube, strip or like material formed by the extruding process or the rolling process and having a coating of brazing powders formed along its length may be cut into sections of a specific length to meet the requirements for the particular application. For example, the long continuous tube, strip or like material of the present invention may be used as a flattened, perforated tube section of heat exchanger that is usually built from a combination of the flattened, perforated tube sections and corrugated fins.

2. Description of the Prior Art

A conventional heat exchanger is usually built from a combination of flattened, perforated tube sections and corrugated fins. Usually, the corrugated fins are formed from a base of aluminum or aluminum alloy which is clad with a sheet of brazing substances, and the tube is formed from a base of aluminum or aluminum alloy by an extruding process. Immediately following the extruding process, a further coating of zinc may be applied onto the tube by flame spraying so that the tube maybe protected against any corrosion.

In building the conventional heat exchanger from the combination of the flattened, perforated tube sections and the corrugated fins as described above, the sheet of brazing substances is attached to the corrugaged fins by passing them through a rolling process which may yield more defective products. When those materials are to be recycled for reuse, it is disadvantageously difficult because they may contain several different types of substances.

When a coating of zinc has been previously applied by the flame spraying process onto the tube, so that the tube may be protected against any corrosion, the products yielded through the flame spraying process may disadvantageously contain more defects. It is also noted that zinc solid powders may disadvantageously be produced during the flame spraying process, which may adversely affect the ambient working environment. Any scraps that may be produced from the finished tubes contain the zinc which was coated in the application process. The tube may be placed under the heat produced during the flame spraying process, which may contribute to the growth of oxide film which may adversely affect the efficiency of the brazing process that occurs following the zinc coating process.

In another conventional heat exchanger that has been proposed more recently, a coating of brazing powders that contain silicon powders as a principal component and a certain type of binder as an auxiliary component is applied and formed on the tube, and no sheet of brazing substances is used on the corrugated fins (International publication No. WO92/12821). In this case, it is found that it is difficult to apply a required amount of such brazing powders over the tube uniformly.

The recent trends are toward the multiflow-type heat exchangers in which the tubes become increasingly thinner. It is therefore desirable that a long continuous tube material should be wound up as a coil as it is being finished, and should then be unwound from the coil and cut to specific sections when it is actually used for building a heat exchanger. It is still difficult to apply the uniform coating of the brazing powders, and is thus difficult to obtain uniformly coated tubes.

SUMMARY OF THE INVENTION

The present invention overcomes the problems of the prior art as described above by providing a long continuous tube, strip or like material having a coating of brazing powders that can improve the product yield, and also by providing a method of and an apparatus for providing such long continuous tube, strip or like materials.

In one aspect, the present invention provides a long continuous tube, strip or like material that has a coating of brazing powders applied and fixed on one side or both sides thereof, and may be cut to specific sections when it is actually used.

In another aspect, the present invention provides a method of and an apparatus for manufacturing such long continuous tube, strip or like material.

In a further aspect, the object of the present invention is to provide a method of and an apparatus for applying a coating mixture of brazing powders having a composition including a zinc component onto the surface of a long continuous tube, strip or like material and fixing the same thereto without the growth of any oxide film formed thereon.

The above object of the present invention maybe achieved by causing a long continuous tube, strip or like material to run at a constant rate, using a spray gun for injecting a coating mixture of brazing powders against the top and/or bottom sides of this running long continuous tube or like material and forming a coating of the brazing powders thereon, drying the coating of the brazing powders formed, and winding the material like a coil.

A long continuous tube, strip or like material having the coating of brazing powders according to the present invention may be a tube that may be formed from aluminum or aluminum alloy by extruding and shaping it to the tubular form, or a strip that may be formed from aluminum or aluminum alloy by rolling it into the strip form. The tube or strip may have a coating of brazing powders applied and fixed to the top and/or bottom sides thereof, which may then be wound like a coil.

The method according to the present invention includes the steps of providing a long continuous tube formed from aluminum or aluminum alloy by the extruding and shaping process, or a long continuous strip formed from aluminum or aluminum alloy by the rolling process, driving the tube or strip to run at a constant rate, injecting a coating mixture of brazing powders against the top and/or bottom sides of the tube or strip from a spray gun and forming a coating of the brazing powders, allowing the coating mixture of brazing powders formed to dry by heating it and thereby fixing it to the top and/or bottom sides of the tube or strip, and winding the tube or strip having the coating of brazing powders fixed thereto like a coil.

The apparatus according to the present invention includes a spray gun section that is provided for injecting a coating mixture of brazing powders toward a travel path along which a long continuous tube formed from aluminum or aluminum alloy by extrusion or a long continuous strip formed from aluminum or aluminum alloy by rolling is running at a constant rate, the spray gun including a pressurized air supply and a brazing power coating mixture supply connected to the spray gun, a drying section located understream of the spray gun, and a winding section.

In the above description, the coating mixture of brazing powders may be composed of a prepared mixture of alloy powders, a binder and a solvent, or a prepared mixture of alloy powders, a binder, a solvent and a flux. Here, the alloy powders may include an alloy in a powdery form composed of aluminum, silicon and zinc, or an alloy in a powdery form which may be composed of aluminum, silicon and zinc as minimum requirements, and at least one selected from the group consisting of indium, bismuth and beryllium.

According to the method and apparatus of the present invention the coating mixture of brazing powders is injected on to the upper and/or lower sides of the long continuous tube, strip or like material and then dried, so that the required amount of coating mixture of brazing powders is injected on to the long continuous tube, strip or like material in a continuous manner under normal temperature, and the long continuous tube, strip or like material having a required amount and a uniform coating of brazing powders fixed on the upper and/or lower side of it is obtained. The before described long continuous tube, strip or like material is made of aluminum or aluminum alloy by the extrusion process or by the rolling process.

The long continuous tube, strip or like material which has the coating of brazing powders applied in accordance with the method or apparatus of the present invention may be wound up into a winding coil, and may subsequently be withdrawn from the coil and cut into sections of specific lengths which maybe used as component parts in a particular machine such as the heat exchanger.

The finished tube or strip that has gone through the various functional sections in the apparatus may be cut to sections, which may be actually used. Those individual tube sections can be transported and handled with ease.

In addition, the present invention improves the product yield.

According to the method and apparatus of the present invention, the predetermined amount of the brazing powder is coated on to the long continuous tube, Strip or like material uniformly in the continuous manner by injecting the coating mixture of brazing powders and then dried, so that uniform coating of brazing powders is formed and fixed on to the long continuous tube, strip or like material which allows the improvement of the manufacture efficiency.

According to the present invention, the coating mixture which is prepared by using powders of an alloy including zinc may contribute to prevent the tube or strip from being overheated, thereby preventing the growth of oxide film.

BRIEF DESCRIPTION OF THE DRAWINGS

The above and other objects, advantages and features of the present invention will become apparent from the detailed description of several preferred embodiments that follows by referring to the accompanying drawings, in which.

DETAILED DESCRIPTION OF THE PREFERRED EMBODIMENTS

Several preferred embodiments of the present invention are described by referring to the accompanying drawings.

Figure 1:
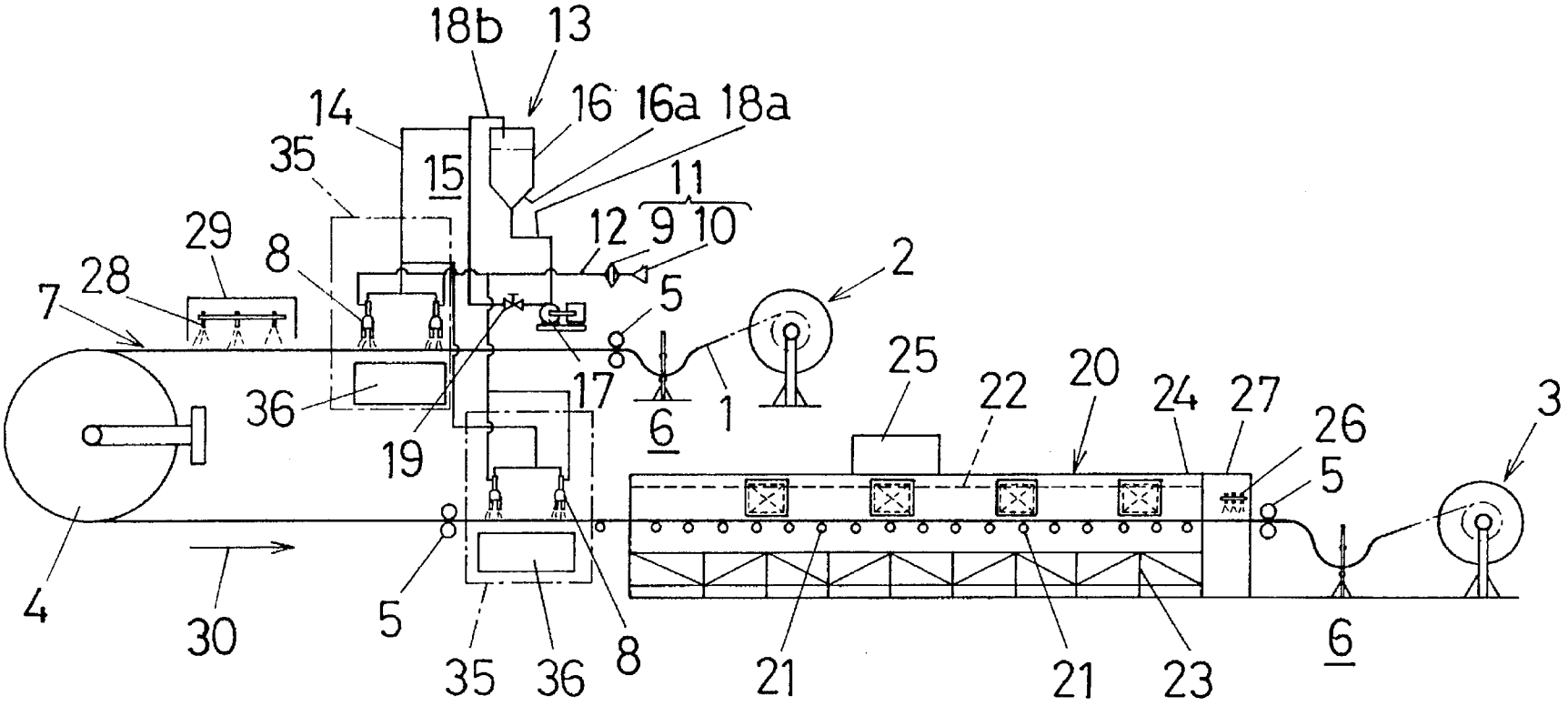
FIG. 1 is a schematic diagram illustrating a general arrangement of an apparatus embodying the present invention.

FIG. 1 represents an overall arrangement of an apparatus according to a preferred embodiment that may be used for applying a coating of brazing powders against a long continuous tube 1, for example, which is typically formed from aluminum or aluminum alloy by an extrusion process. In the following description, the tube 1 will be referred to simply as the "tube 1". In FIG. 1, the apparatus includes an unwinding section 2 for supplying the tube 1, which is wound like a coil, a rewinding section 3 for accepting a finished tube 1 and rewinding it up as a wound coil, a reversing roll 4, first and second pairs of parallel rollers 5, 5, and first and second pilot stands 6, 6. The tube 1 from the unwinding section 2 runs along a travel path through the intervening functional sections up to the rewinding section 3. Specifically, the tube 1 is first unwound from the unwinding section 2, and then passes through the first pilot stand 6 and then through the first pair of guide rollers 5, reaching the reversing roll 4 where the tube 1 is reversed and runs in the opposite direction. After passing through the reversing roll 4, the tube 1 passes through the second pair of guide rollers 5, 5 and then through the second pilot stand 6, reaching the rewinding section 3 where it is wound up again.

Two pairs of spray guns 8, 8 are included, and are located at respective appropriate positions along a travel path 7. Specifically, the first pair of spray guns 8, 8 is located upstream of the reversing roll 4 and is provided above the travel path 7, and the second pair of spray guns 8, 8 is located downstream of the reversing roll 4 and is provided above the travel path 7. The pairs of spray guns are supported by any suitable supporting members, which are not shown, because those members are not directly relevant to the present invention. A pressurized air supply section, generally designated by 11, includes an air filter 9 and a pressurized air supply source 10, and is connected to each pair of spray guns 8, 8 through a feed line 12. A supply section 13 for supplying a coating mixture of brazing powders is connected to each pair of spray guns 8, 8 through a feed line 14.

Figure 2:
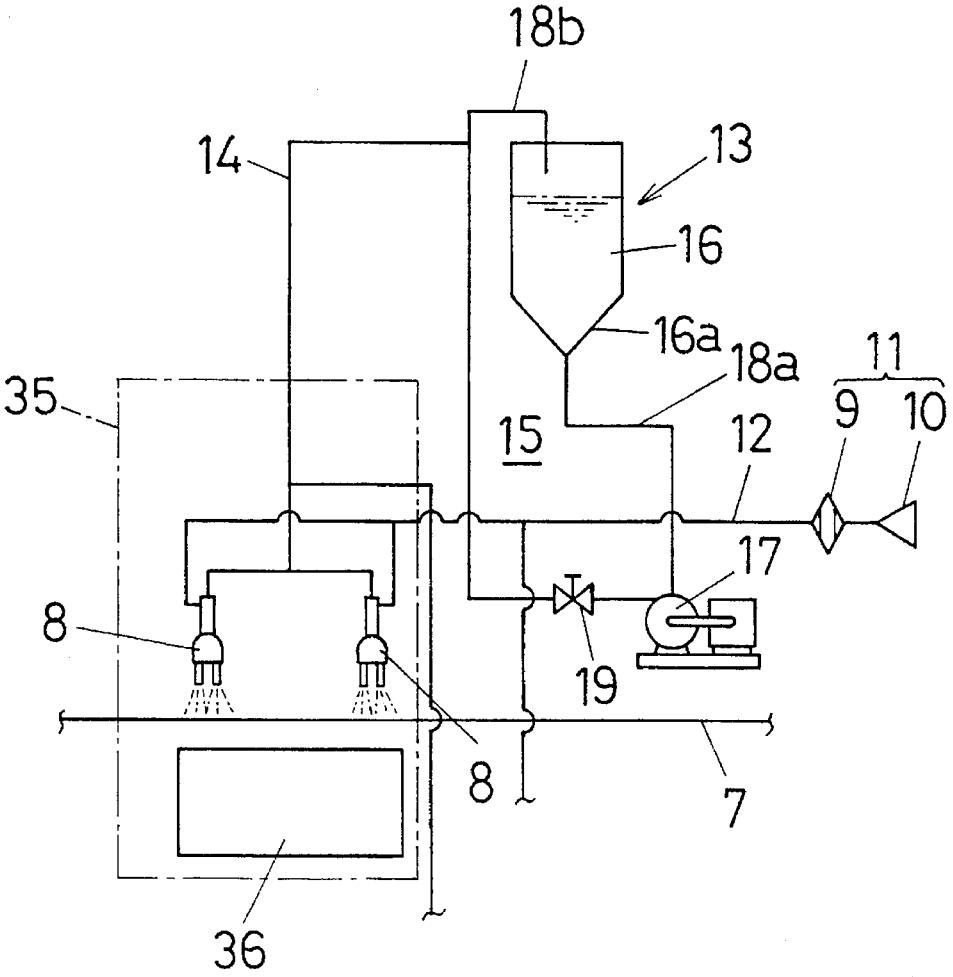
FIG. 2 is a schematic diagram illustrating part of the apparatus of FIG. 1 shown on an enlarged scale.

As its details are shown in FIG. 2, the coating mixture supply section 13 includes a coating mixture circulating device, generally designated by 15, and a feed line 14. The coating mixture circulating device 15 includes a hopper-like coating mixture reservoir tank 16 having a funnel-shape outlet 16*a*, a coating mixture delivery pump 17 and a circulating line 18*a* connected between the funnel shape outlet 16*a* of the reservoir tank 16 and the inlet side of the coating mixture delivery pump 17. The circulating device 15 further includes a flow regulator valve 19 and a circulating line 18*b* which connects between the outlet side of the delivery pump 17 and the open top of the reservoir tank 16 through the intervening flow regulator valve 19. The feed line 14 is branched from the circulating line **18*b* on the downstream side of the flow regulator valve 19**.

On the downstream side of the second pair of spray guns 8, 8 which is located downstream of the reversing roll 4, there is a drying section, generally designated by 20, through which the travel path 7 runs. The drying section 20 includes a series of rollers 21, 21 that forms the travel path 7 (those rollers may be replaced with a floating unit by the action of the pressurized air), and a medium-frequency wave heater 22 such as the far infrared ray heater. The rollers 21, 21 and medium-frequency wave heater 22 in the drying section 20 are housed inside a cylindrical housing 24 supported on a pedestal 23. The cylindrical housing 24 includes a circulating fan 25 at the top which forces the air inside the housing 24 to circulate.

On the exit side of the drying section 20, there is a cooler 27 with an air blower nozzle 26. On the section of the travel path 7 between the reversing roll 4 and the first pair of spray guns 8, 8 located upstream of the reversing roll 4, there is a preliminary drying section 29 which has a hot air blower nozzle 28. The hot air may be blown through the nozzle 28 at 50° C. to 150° C.

Each spray gun in each pair has a nozzle diameter of between 0.7 mm ϕ and 1.2 mmϕ, and may deliver an output at the rate of 70 cc/min to 200 cc/min., which may be variably adjusted. As an example of the spray gun that may be employed, there is a compact automatic spray gun model T-AGB or T-AGHV offered by the Landsberg Industry Corp.

Now the process of applying a coating mixture of brazing powders onto a long continuous tube, strip or like material (which will be referred to now simply as a long continuous material 1) and fixing the coating of brazing powders thereto by using the apparatus of the preferred embodiment described above will be described. A coating mixture of brazing powders is injected from the spray guns 8, 8 against one side of the long continuous material 1 traveling along the upstream side of the travel path, thereby forming a coating of the brazing powders. Then, the long continuous material 1 passes through the reversing roller 4, where it is reversed, traveling in the opposite direction and running along the downstream side of the travel path 7. A coating mixture of brazing powders is injected from the further spray guns 8, 8 against the other side of the long continuous material 1 which is now traveling downstream. The long continuous material 1, having the coating of the brazing powders formed on both sides thereof, passes through the drying section 20, where the coating is dried and fixed to the long continuous material 1. It should be noted that the spray guns 8, 8 on the upstream side of the travel path 7 and the spray guns 8, 8 on the downstream side may both be operated concurrently, or either may be operated alone. When the upstream and down stream spray guns are both operated, the coating of brazing powders may be formed and fixed on both sides of the long continuous material 1 simultaneously. Alternatively, when either of the upstream and downstream spray guns is operated alone, the coating of brazing powders maybe formed and fixed on the corresponding side of the long continuous material 1.

Figure 3:
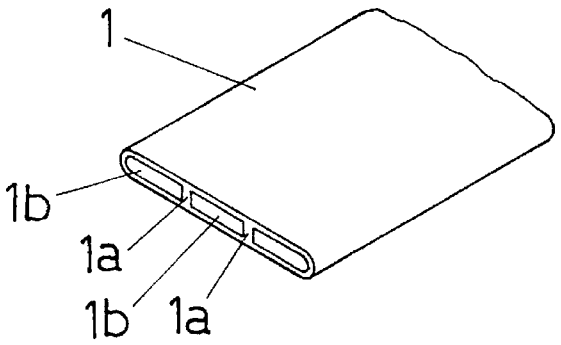
FIG. 3 is a perspective view illustrating one section of a long, flattened, perforated tube having a coating of brazing powders applied thereto formed by injecting a coating mixture of brazing powders against the tube from the apparatus shown in FIGS. 1 and 2.

The long continuous material 1 that may be used in the embodiment may be a long continuous, flattened, perforated tube formed from aluminum or aluminum alloy by extrusion, having an inner separating wall **1*a* and a bore 1*b* extending along the length of the tube. The tube 1 may have a width of 16 mm to 25 mm, the thickness of 1 mm to 5 mm, and a material thickness of 0.3 mm to 1.0 mm. Note FIG. 3**.

It should be understood that the present invention is not limited to the long continuous, flattened, perforated tube as mentioned above, but may include a long continuous tube formed from aluminum or aluminum alloy by extrusion, or a strip formed from aluminum or aluminum alloy by rolling.

The coating mixture of brazing powders may be a prepared mixture of an alloy in a powdery form (having a grain size of about 40 μm) composed of aluminum (Al), silicon (Si) and zinc (Zn), to which any acrylic binder may be added as a binder and any alcohol (such as isopropyl alcohol) may be added to provide a viscosity of 60 cp (centipoise). The Al-Si-Zn alloy may have the composition including 10% of silicon (Si), 5% of zinc (Zn) and the remaining components including aluminum (Al) and any unavoidable impurities.

The reservoir tank 16 within the coating mixture circulating section 15 contains the coating mixture of brazing powders, and the delivery pump 17 is running so that the coating mixture can always be circulating, thereby preventing the Al-Si-Zn alloy brazing powders from precipitating within the tank 16. During the operation, a part of the circulating coating mixture is delivered through the feed line 14 into the first pair of spray guns 8, 8 and then into the second pair of spray guns 8, 8. The spray guns 8, 8 in each pair may be activated by the pressurized air from the pressurized air supply section 11 to inject the coating mixture of brazing powders toward the travel path 7.

The tube 1 maybe running along the travel path 7 at the rate of 15 m/min in the direction of arrow 30, and is first passing through the region of the first pair of spray guns 8, 8 located upstream of the reversing roll 4 where the coating mixture of brazing powders is projected from the spray guns against one side (upper side) of the running tube 1. The coating mixture may be provided at the rate of 60 g/m$^2$, and the resulting coating may have an average thickness of 30 μm.

Following the first pair of spray guns 8, 8, the tube 1 is further goes through the preliminary drying section 29 where the coating of the mixture of brazing powders just formed on the one side of the tube 1 is preliminarily dried by blowing hot air against it. After any "stickiness" is removed from the coating through the drying section 29, the tube 1 then runs toward the reversing roll 4 where it is reversed to run in the opposite direction.

On the downstream side of the reversing roll 4, the tube 1 passes through the region of the second pair of spray guns 8, 8 which projects the coating mixture of brazing powders against the opposite side (lower side) of the running tube 1, and then passes through the drying section 20 where the coating just formed on the opposite side is dried. During the drying process, the coating of the Al-Si-Zn alloy brazing powders contained in the coating mixture are fixed to the upper and lower sides of the tube 1 with the aid of the binder also contained in the coating mixture. The tube 1 has a uniform thickness of coating thus formed on each of the upper and lower sides thereof which is equal to 30 μm.

In the drying section 20, the internal temperature should preferably be set to 150° C., and the transit time through the drying section 20 should preferably be set to 40 seconds.

Following the drying section 20, the tube 1 passes through the cooling section 27, where it is cooled. Finally, the tube 1 that has passed through the functional sections is rewound as a winding coil at the rewinding section 3. Thus, the finished tube has the uniform coating of the brazing powders on both sides thereof.

The finished tube 1 may be unwound from its winding coil, and may be cut to sections of a specific length.

Figure 4:
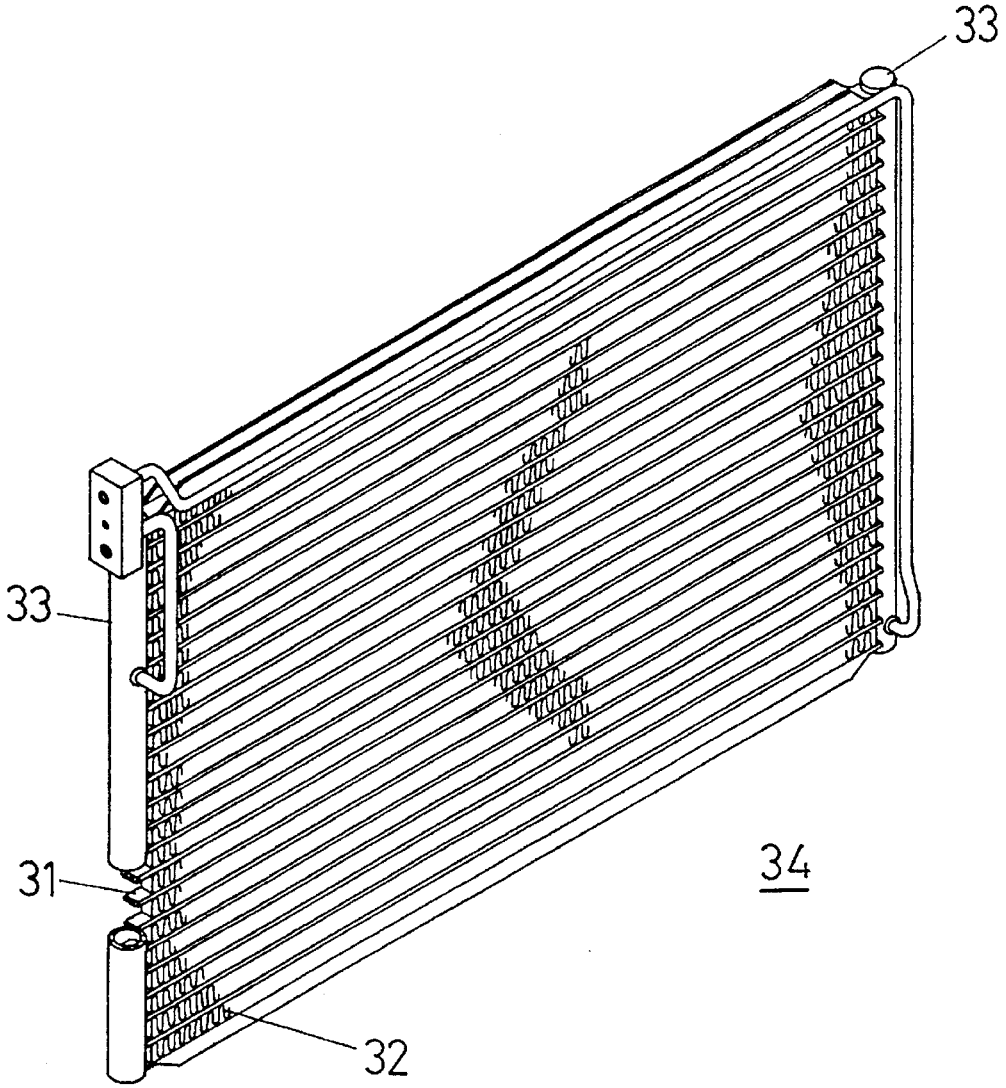
FIG. 4 is a perspective view illustrating a heat exchanger including sections of the tube of FIG. 3 according to the present invention, which tubes are shown at the broken away portion.

For example, as shown by FIG. 4, individual tube sections 31 may be combined with the corresponding corrugated fins formed from an aluminum alloy plate 32 and header pipes 33. Those elements may be joined together by brazing under the application of heat. The brazing process preferably occur at 600° C. for five minutes under a nitrogen gas atomosphere. A heat exchanger 34 that contains the elements is shown in FIG. 4. Table 1 presents the results obtained by checking and assessing the interesting parameters of the finished tube 1.

TABLE 1

| Parameters | Results |
|---|---|
| Coating thickness | 30 ± 5 μm |
| Coating weight | 60 ± 5 g/m$^2$ |
| Brazing joining rate | 98% |
| SWAAT 20 days | good |

In the embodiment described so far, the travel path 7 includes a single track along which a single tube 1 runs, but it may include more than one track, in which case a pair of spray guns 8, 8 may be provided for each of the tracks or a single common pair of spray guns 8, 8 may be provided across all of the tracks. It may be understood that in either case, the pair of spray guns 8, 8 maybe provided on the upstream and downstream sides of the reversing roll 4, respectively.

In the embodiment, the pair of spray guns on each respective one of the upstream and downstream sides of the reversing roll 4 includes two spray guns 8, 8 across the travel path 7. Alternatively, it may include one or more than two spray guns, depending upon the coating requirements. A single spray gun may satisfy the minimum coating requirements, but two or more spray guns provide a more consistent coating than the single spray gun, because they can provide several layers of the coating.

In the embodiment, the reversing roll 4 is provided for reversing the tube 1 to run in the opposite direction. This is advantageous in that the space requirements for the coating section can be saved. If this is not an important consideration, the reversing roll 4 may be eliminated.

In the embodiment, one pair of spray guns 8, 8 is provided on each respective one of the upstream and downstream sides of the reversing roll 4. That is, the first pair of spray guns 8, 8 on the upstream side is used for one side (upper) of the tube 1, and the second pair of spray guns 8, 8 is used for the opposite side (lower) of the tube 1. Alternatively, those first and second pairs of spray guns 8, 8 may be placed in the same location so that they can project the coating mixture of brazing powders against the upper and lower sides of the tube 1 concurrently. Also, only one pair of spray guns 8, 8 maybe used for obtaining the tube 1 having the coating of brazing powders only on one side of it according to the coating requirements. The coating mixture of brazing powders projected from each of the pairs of spray guns may spread over the area surrounding the tube 1, and it is thus preferred that the first and second pairs of spray guns are located separately as in the embodiment, because some of the projected coating mixture must be collected for any subsequent treatment.

The amount of coating of the brazing powders maybe determined depending upon the speed with which a tube 1 is running, and may also be determined by adjusting the amount of the coating mixture to be projected by the pair of spray guns 8, 8. The coating may also be formed continuously along the length of the running tube 1.

In FIGS. 1 and 2, a booth is shown by the dot-and-dash lines 35, which encloses the region of each respective pair of spray guns 8, 8. Within the booth 35, there is a collector 36 for collecting some of the coating mixture of brazing powders injected from each respective pair of guns. As shown, each collector 36 is located on the side of the travel path 7 opposite the pair of spray guns.

Figure 5:
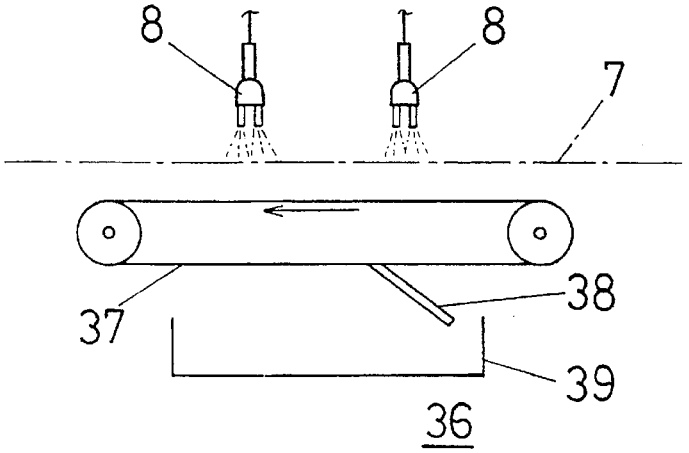
FIG. 5 is a schematic diagram illustrating a brazing powders collecting section in the apparatus according to the present invention.

As shown in FIG. 5, the collector 36 includes an endless belt conveyor 37 in parallel with the travel path 7 and a scraper plate 38 that engages the endless belt conveyor 37 on one side thereof.

Part of the coating mixture of brazing powders injected from the pair of spray guns, which is not coated on the tube 1 running on the travel path 7, may be accepted by the endless belt conveyor 37. That part is carried on the endless belt conveyor 37, and is then removed from the belt by the scraper plate 38 and collected back into a collector 39.

Preferably, the tube 1 may be preheated before the coating occurs. In the embodiment shown in FIGS. 1 and 2, a hot air blower (not shown) that blows a hot air stream against the travel path 7 may be provided upstream of the first pair of spray guns 8, 8 located on the upstream side of the reversing roll 4. When the tube 1 is running past the hot air blower, it may be preheated to a temperature range of between 60° C. and 100° C. In this way, the coating can occur under consistent conditions, and all products (finished tubes) can have a consistent quality.

It should be understood that the present invention is not limited to the particular coating mixture of brazing powders prepared as described above in the particular embodiment.

In the embodiment described above, the Al-Si-Zn alloy in its powdery form has a grain size of about 40 μm, but the present invention is not limited to this particular grain size. It maybe appreciated that the grain size allowed for the alloy powders may be varied, depending upon the particular coating thickness of the alloy powders being coated on and fixed to the surface of the particular long continuous tube, strip or like material, because the coating thickness may also be varied, depending upon the particular application in which the long continuous tube or like material is used. For example, when the long continuous material is flattened and perforated tube formed by extrusion that is used in the heat exchanger, the coating thickness of the brazing powders being coated on and fixed to the tube should be less than a certain value, as it may serve as the cladding layer. Accordingly, the brazing powders should also have a grain size diameter of less than a certain value. As such, the alloy powders that may be used should have a grain size of the order of 100 μm at the maximum.

The present invention is not limited to the particular composition of the aluminum (Al)-silicon (Si)-zinc (Zn) alloy as described in the above embodiment. Instead of using the brazing powders having the composition as described above, a coating mixture of brazing powder maybe prepared by using Al-Si-Zn alloy having a composition that may consists of the respective ranges of 5 to 20% of silicon (Si), 1 to 55% of zinc (Zn), and the remaining components including aluminum (Al) and any unavoidable impurities. Those respective ranges are preferred because they can meet the requirements of the heat exchanger for adequate brazing capability and corrosion resistance.

It should also be noted that the alloy in its powdery form that may be used for the purposes of the present invention is not limited to the aluminum (Al)-silicon (Si)-zinc (Zn) alloy as described above. The component of zinc that is contained in the alloy composition may be served for improving corrosion resistance of aluminum. As such, any one or more of the different elements, such as indium (In), bismuth (Bi), beryllium (Be) and the like, that provide the equivalent functions of zinc, may be added to the above alloy composition. More specifically, a coating mixture of brazing powders maybe prepared by using the powdery alloy that includes at least one of the elements such as indium (In), bismuth (Bi) and beryllium (Be), in addition to the elements of aluminum (Al), silicon (Si) and zinc (Zn) as minimum requirements.

Note that the coating mixture of brazing powders that is prepared by using the aluminum (Al)-silicon (Si) alloy powders according to the conventional method and apparatus in general may also be used for the purposes of the present invention.

In the above described embodiment, isopropyl alcohol is used in preparing the coating mixture of brazing powders. Other alcohols may also be used, such as aliphatic alcohols containing less than carbons 8 (for example, methanol, ethanol, butanol, etc.).

A flux may be added to the binder when the coating mixture of brazing powders is prepared.

The coating mixture of brazing powders that may be obtained according to the preceding embodiment has a viscosity of 60 cp (centipoise). Note that the present invention is not limited to this value because it may be varied, depending upon the particular coating and operating requirements.

A long continuous, flattened, perforated tube 1 that is shaped by an extrusion process is used in the preceding embodiment, but other long continuous materials maybe used, such as a long continuous strip that maybe shaped by a rolling process and maybe wound like a coil. Such a strip may have a coating mixture of brazing powders applied on and fixed to the top and/or bottom sides thereof. The finished strip maybe re-wound like a coil.

Figure 6:
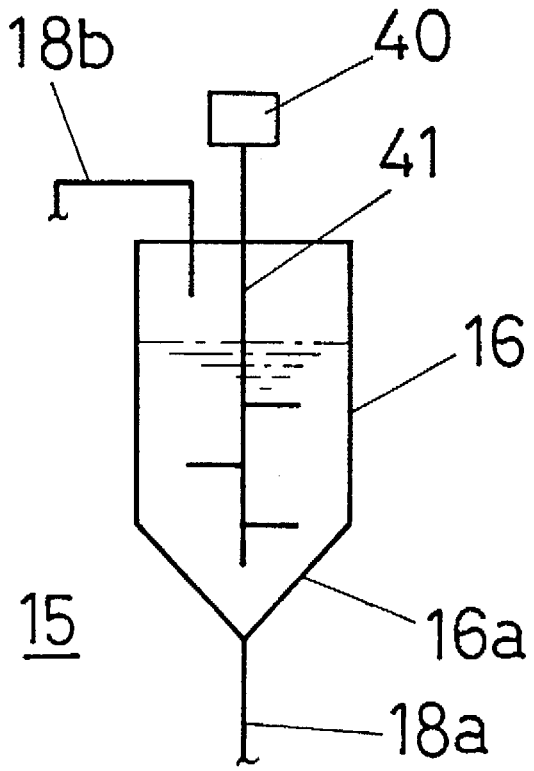
FIG. 6 is a schematic diagram illustrating a reservoir tank for containing a coating mixture of brazing powders within a coating mixture circulating section in the apparatus according to another embodiment of the present invention.

A stirrer 41, driven by a motor 40, maybe provided in the reservoir tank 16 within the coating mixture circulating section 15, as shown in FIG. 6. The component consistency can be maintained by allowing the coating mixture to circulate as described, but the stirrer 41 may further improve the consistency.

Although the present invention has been described with reference to several particular preferred embodiments, it should be understood that various changes and modifications maybe made without departing from the spirit and scope of the invention as defined in the appended claims.

What is claimed is:

1. A method of manufacturing a continuous tube, comprising:

unwinding an elongate and continuous tube having top and bottom sides from a first wound coil of elongate and continuous tubing and feeding the elongate and continuous tube to a first end of a tube feed path;

conveying the elongate and continuous tube at a constant rate along the tube feed path while continuing to unwind the elongate and continuous tube from the first wound coil;

applying a coating mixture of brazing powders to at least one of the top and bottom sides of the elongate and continuous tube while the elongate and continuous tube is conveyed along the feed path during said step of conveying;

drying the coating mixture of brazing powders applied on the elongate and continuous tube during said step of applying by heating the elongate and continuous tube while the elongate and continuous tube is further conveyed along the feed path during said step of conveying, thereby fixing the brazing powders to the at least one of the top and bottom sides of the elongate and continuous tube; and rewinding the elongate and continuous tube into a second wound coil of elongate and continuous tubing at a second opposite end of the tube feed path;

wherein the elongate and continuous tube continues from the first wound coil to the second wound coil at a constant rate while each of said steps of unwinding, conveying, applying, drying and rewinding are performed continuously until the entirety of the elongate and continuous tube has been coated and rewound into the second wound coil.

2. The method of claim 1, and further comprising the step of:

reversing the direction of travel of the elongate and continuous tube by extending the tube feed path around a reversing roller, wherein said step of applying takes place both before and after said step of reversing.

3. The method of claim 1, and further comprising the step of:

reversing the direction of travel of the elongate and continuous tube by extending the tube feed path around a reversing roller;

wherein said step of applying comprises applying the coating mixture to one of the top and bottom sides upstream of the reversing roller, preliminarily drying the one of the top and bottom sides upstream of the reversing roller, and applying the coating mixture to the other of the top and bottom sides downstream of the reversing roller.

4. The method of claim 1, wherein said step of unwinding further comprises unwinding at least two elongate and continuous tubes in parallel, and each of said steps of conveying, applying, drying and rewinding are carried out with respect to all of said elongate and continuous tubes, with all of said elongate and continuous tubes running in parallel along the tube feed path.

5. The method of claim 2, wherein said step of unwinding further comprises unwinding at least two elongate and continuous tubes in parallel, and each of said steps of conveying, applying, drying and rewinding are carried out with respect to all of said elongate and continuous tubes, with all of said elongate and continuous tubes running in parallel along the tube feed path.

6. The method of claim 3, wherein said step of unwinding further comprises unwinding at least two elongate and continuous tubes in parallel, and each of said steps of conveying, applying, drying and rewinding are carried out with respect to all of said elongate and continuous tubes, with all of said elongate and continuous tubes running in parallel along the tube feed path.

7. The method of claim 1, wherein said step of applying comprises spraying one side of the elongate and continuous tube more than one time with the coating mixture of brazing powders.

8. The method of claim 3, wherein said step of applying comprises spraying each side of the elongate and continuous tube more than one time with the coating mixture of brazing powders.

9. The method of claim 1, and further comprising the step of:

heating the elongate and continuous tube to a predetermined temperature before said step of applying.

10. The method of claim 1, wherein said step of applying further comprises circulating a supply of the coating mixture of brazing powders through a circuit so as to prevent precipitation, feeding a portion of the coating mixture that is being circulated from the circuit to the spray gun and spraying the coating mixture with the spray gun.

11. The method of claim 1, wherein said step of applying further comprises receiving a portion of the coating mixture sprayed by the spray gun but not applied to the elongate and continuous tube with an endless belt and collecting the portion from the endless belt.

12. The method of claim 1, wherein said step of applying comprises applying a coating mixture of brazing powders that comprises a combination of an alloy powder, a binder and a solvent.

13. The method of claim 12, wherein said step of applying comprises applying a coating mixture of brazing powders that comprises a combination of an alloy powder, a binder, a solvent and a flux.

14. The method of claim 13, wherein the alloy powder comprises an alloy in powder form comprising aluminum, silicon and zinc.

15. The method of claim 14, wherein the alloy powder further comprises at least one material selected from the group consisting of indium, bismuth and beryllium.

* * * * *